US005125866A

United States Patent [19]

Arad et al.

[11] Patent Number: 5,125,866

[45] Date of Patent: Jun. 30, 1992

[54] ELECTRONIC SOUND-GENERATING SIMULATED BABY BOTTLE TOY

[75] Inventors: Avi Arad, Westport, Conn.; Joseph Truchsess, City Island, N.Y.

[73] Assignee: Tyco Industries, Inc., Mount Laurel, N.J.

[21] Appl. No.: 695,831

[22] Filed: May 6, 1991

[51] Int. Cl.[5] ..... A63H 5/00; A63H 3/00; A63H 3/52; A63H 3/28

[52] U.S. Cl. ..... 446/397; 446/74; 446/267; 446/268; 446/302; 446/484

[58] Field of Search ..... 369/63, 65; 446/71, 446/73, 74, 76, 81, 267, 268, 297, 299, 302, 303, 397, 404, 484

[56] References Cited

U.S. PATENT DOCUMENTS

| | | | |
|---|---|---|---|
| De. 303,431 | 9/1989 | Brown | D21/64 X |
| 3,514,899 | 6/1970 | Bonanno et al. | 446/298 |
| 3,627,161 | 12/1971 | Wergeland | 446/81 X |
| 3,729,859 | 5/1973 | Smith, III et al. | 446/267 |
| 3,755,960 | 9/1973 | Tepper et al. | 446/299 |
| 3,949,488 | 4/1976 | Welch | 446/302 X |
| 4,160,339 | 7/1979 | Dankman et al. | 446/231 |
| 4,219,962 | 9/1980 | Dankman et al. | 446/409 |
| 4,221,927 | 9/1980 | Dankman et al. | 446/175 X |
| 4,249,338 | 2/1981 | Wexler | 446/303 |
| 4,267,551 | 5/1981 | Dankman et al. | 446/295 X |
| 4,276,714 | 7/1981 | Albert et al. | 446/300 |
| 4,311,310 | 1/1982 | Dankman et al. | 273/109 |
| 4,318,245 | 3/1982 | Stowell et al. | 446/303 |
| 4,331,836 | 5/1982 | Wiggins, Jr. et al. | 381/51 |
| 4,355,483 | 10/1982 | Korzelius | 446/484 |
| 4,451,911 | 5/1984 | Klose et al. | 446/302 X |
| 4,516,950 | 5/1985 | Berman et al. | 446/297 |
| 4,678,093 | 7/1987 | Allen | 369/63 X |
| 4,687,457 | 8/1987 | Milner | 446/175 |
| 4,765,465 | 8/1988 | Yamada et al. | 369/63 X |
| 4,802,879 | 2/1989 | Rissman et al. | 446/297 X |
| 4,809,335 | 2/1989 | Rumsey | 446/297 X |
| 4,810,997 | 3/1989 | Kudo et al. | 381/90 X |
| 4,898,060 | 2/1990 | To | 446/227 X |
| 4,944,704 | 7/1990 | Grace | 446/74 |
| 4,973,941 | 11/1990 | Davis et al. | 446/297 X |
| 5,011,449 | 4/1991 | Handy et al. | 446/297 |

FOREIGN PATENT DOCUMENTS

| | | | |
|---|---|---|---|
| 0231142 | 8/1987 | European Pat. Off. | 446/297 |
| 2572300 | 5/1986 | France | 446/409 |

OTHER PUBLICATIONS

Technical description of MSS0301 MOSEL Speech Synthesizer (Voice ROM) printed Dec. 1989.

*Primary Examiner*—Robert A. Hafer
*Assistant Examiner*—D. Neal Muir
*Attorney, Agent, or Firm*—Panitch, Schwarze, Jacobs & Nadel

[57] ABSTRACT

An electronic simulated baby bottle toy generates human-like sounds and includes a cylindrically-shaped hollow housing portion with a nipple-shaped member mounted on one end of the housing portion to simulate a nurser bottle. Four microswitches within the toy can be individually activated by applying pressure to the nipple member or to a flexible cover on the side of the housing portion. The switches selectively activate a VLSI synthesizer chip which generates any of four signals. Each signal controls a sound transducer causing the transducer to generate a selected human-like sound.

16 Claims, 4 Drawing Sheets

ELECTRONIC SOUND-GENERATING SIMULATED BABY BOTTLE TOY

FIELD OF THE INVENTION

The present invention relates to simulated drinking implement toys and, more particularly, to an electronic sound-generating simulated baby bottle toy for generating human-like sounds.

BACKGROUND OF THE INVENTION

The concept of toy dolls with sound generating capabilities is well-known. Dolls frequently have been designed to simulate the sounds of a baby. Previously, mechanical mechanisms located within the body of a doll were utilized to simulate the sounds. Mechanical mechanisms were used for several reasons. First, since dolls were usually somewhat large in size, their size allowed for large and bulky mechanical mechanisms to be inserted without difficulty into the interior of the doll. Second, mechanical mechanisms were usually inexpensive to manufacture and insert into a doll. Third, mechanical mechanisms were durable, and because of their durability were well suited for children's toys. However, the fact that mechanical mechanisms were large and bulky prevented them from being used with smaller toys.

Other technologies, have also proved to be ill-suited for use with smaller toys. For example, U.S. Pat. No, 3,949,488 is for an educational associativity rag doll in which a tape playback means, such as a cassette recorder is secured within the interior of the doll. The cassette recording is played back upon activating various button activating means located on the body of the doll. The doll is capable of playing back a plurality of recorded messages. However, the suggested size of the doll is approximately 34" high which enables it to receive the still relatively bulky electronics package. Such a means of generating a plurality of different sounds would not be suitable for use with smaller toys.

Recently, many toys, including dolls, have been designed to use electronics technology in order to simulate various sounds. The use of electronics in toys though, has not always been ideal. Electronics are expensive and, combining the expense of electronics with the increased manufacturing costs incurred when using electronics, serves to increase the cost of the final product. Because toys are usually purchased for children by their parents, it is desirable to keep the cost of toys down. Parents realize that children are fickle and become bored easily, and thus, do not want to spend an exorbitant amount of money on toys. Also, electronics usually have not been designed to withstand physical rigors. If electronics are to be used successfully in toys used by small children, the electronics of a toy have to be protected from the physical abuse small children can inflict on toys. Generally speaking, it may be more difficult to protect such components in smaller toys because of the lack of room in such toys for supportive and protective structure or padding.

Frequently, dolls are not used alone but in conjunction with other toys. Since a doll essentially is a toy used by children to simulate the activities of a baby, toys which assist in the simulation of baby's activities are usually used along with a doll. For example, during play children will dress and undress a doll or will attempt to simulate the feeding of a baby with a toy bottle. A toy baby bottle that is able to produce human-like sounds which is used along with a doll would greatly assist in furthering the simulation in children's minds that they are feeding a baby.

In the past, various types of mechanical and electronic devices have been used to simulate different sounds in toys. The problems previously indicated have been inherent in these toys. U.S. Pat. No. 3,729,859 is for a baby bottle which simulates a gurgling sound. Contained within the housing of the bottle is a mechanical mechanism which includes a hammer assembly mounted on a cylindrical shaft. The gurgling sound is produced when the hammer assembly vibrates as it traverses the shaft. The device is capable of only generating one sound, that of a baby's gurgling.

U.S. Pat. No. 4,451,911 is directed to a toy figure such as a doll that responds to the selection of one of a plurality of switches on the housing of the doll by mechanically playing back various vocal messages. Circuitry in the doll stores and controls operating instructions which also include a problem solution mode of operation wherein a selected one of the messages is played announcing a problem and a corresponding one of the switches is exclusively selected to affect the corresponding proper solution upon activation by the user. Although electronics is used to control the operations of the doll, the actual playback device, preferably is a record player, which is also located within the interior of the doll.

Mechanical mechanisms used to simulate multiple sounds in a doll, like the record player of U.S. Pat. No. 4,451,911, are, generally speaking, too large to use in smaller toys such as baby bottles. Furthermore, the problems inherent in the use of electronics are applicable to a toy baby bottle. Parents may not be willing to spend substantial sums of money on toys for small children. Because a toy baby bottle is relatively small, it may be difficult to protect electronics contained within it from the stresses placed on the toy baby bottle by small children.

It would be desirable then to have a toy baby bottle or other drinking implement which can be used alone or in conjunction with a doll to further assist in the simulation of a baby's activities. Such a toy baby bottle is particularly desirable if it is durable and can simulate several different typical baby activities, thus increasing the play span of a doll by using the toy baby bottle or other drinking implement.

SUMMARY OF THE INVENTION

Briefly stated, the present invention is, in one aspect, a simulated drinking implement toy for selectively generating human-like sounds. The simulated drinking implement toy comprises a housing means for duplicating an appearance of a drinking implement and a sound transducer means within the housing means for generating sounds. The toy further comprises circuit means within the housing means coupled to the sound transducer means for selectively generating a plurality of different signals to control the sound transducer means to generate a plurality of different human-like sounds. The toy further comprises switch means coupled with the circuit means for activating the circuit means to selectively generate one of the plurality of different signals.

The present invention is also, in another aspect, a simulated drinking implement for selectively generating human-like sounds comprising housing means for duplicating an appearance of a drinking implement; sound transducer means within the housing for generating sounds; circuit means within the housing means coupled with the sound transducer means for generating a signal to control the sound transducer means to generate a human-like sound; first switch means coupled with the circuit means and adapted for activating the circuit means to generate a sound transducer controlling signal when the toy is used to simulate drinking; and second switch means coupled with the circuit means and located for selectively activating the circuit means to generate a second sound transducer controlling signal independently of the first switch means.

The present invention further includes an electronic simulated baby bottle toy for electronically generating human-like sounds. The baby bottle toy comprises a generally cylindrically-shaped hollow housing portion simulating a nurser bottle and a generally nipple-shaped member mounted on one end of the housing portion. The toy further comprises a sound transducer means covered by the housing portion and by the nipple-shaped member and located proximal the nipple-shaped member for generating sounds proximal the nipple-shaped member. The toy further comprises circuit means within the housing portion coupled with the sound transducer means for generating a signal controlling the sound transducer means to produce a human-like sound, and a plurality of switch means controllable from outside the toy for selectively activating the circuit means to drive the sound transducer means.

BRIEF DESCRIPTION OF THE DRAWINGS

The foregoing summary, as well as the following detailed description of the presently preferred embodiment of the invention will be better understood when read in conjunction with the appended drawings. For the purpose of illustrating the invention, there is shown in the drawings an embodiment which is presently preferred. It should be understood, however, that the present invention is not limited to the particular arrangements and instrumentalities shown. In the drawings.

DESCRIPTION OF PREFERRED EMBODIMENT

The presently preferred embodiment of the invention described below is a baby bottle toy for generating several different human-like sounds.

Figure 1:
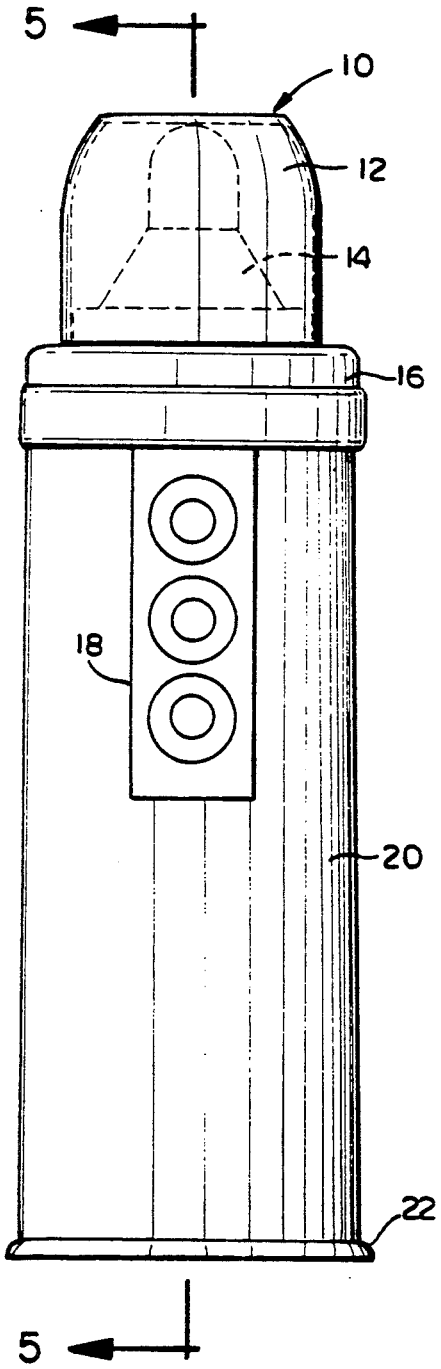
FIG. 1 is a side elevational view of a toy baby bottle in accordance with the present invention.
Figure 3:
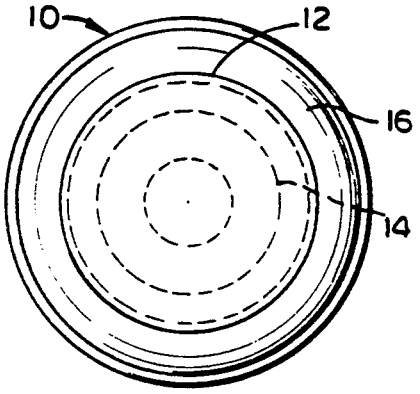
FIG. 3 is a top plan view of the toy baby bottle shown in FIG. 1.

FIG. 1 is a side elevational view of the baby bottle toy, hereinafter referred to as the bottle toy 10. The bottle toy 10 includes housing means for duplicating an appearance of a drinking implement, namely a nurser bottle. The housing means preferably includes a generally cylindrically-shaped hollow housing portion 20, a nipple-shaped member 14, an annular cap 16 for mounting the member 14 to one end of the housing portion 20, a flexible member 18 inserted into a cut-out provided in the cylindrical walls of the housing portion 20, and a base end 22. A cover 12 for the nipple-shaped member 14 is also preferably provided but could be omitted. It should be appreciated that the purpose of the shape of the bottle toy 10 shown in FIG. 1 is to simulate the appearance of a nurser bottle. The bottle toy 10, therefore, is preferably of a size comparable to that of an actual nurser bottle or is of a reduced size for use by smaller children.

Figure 2:
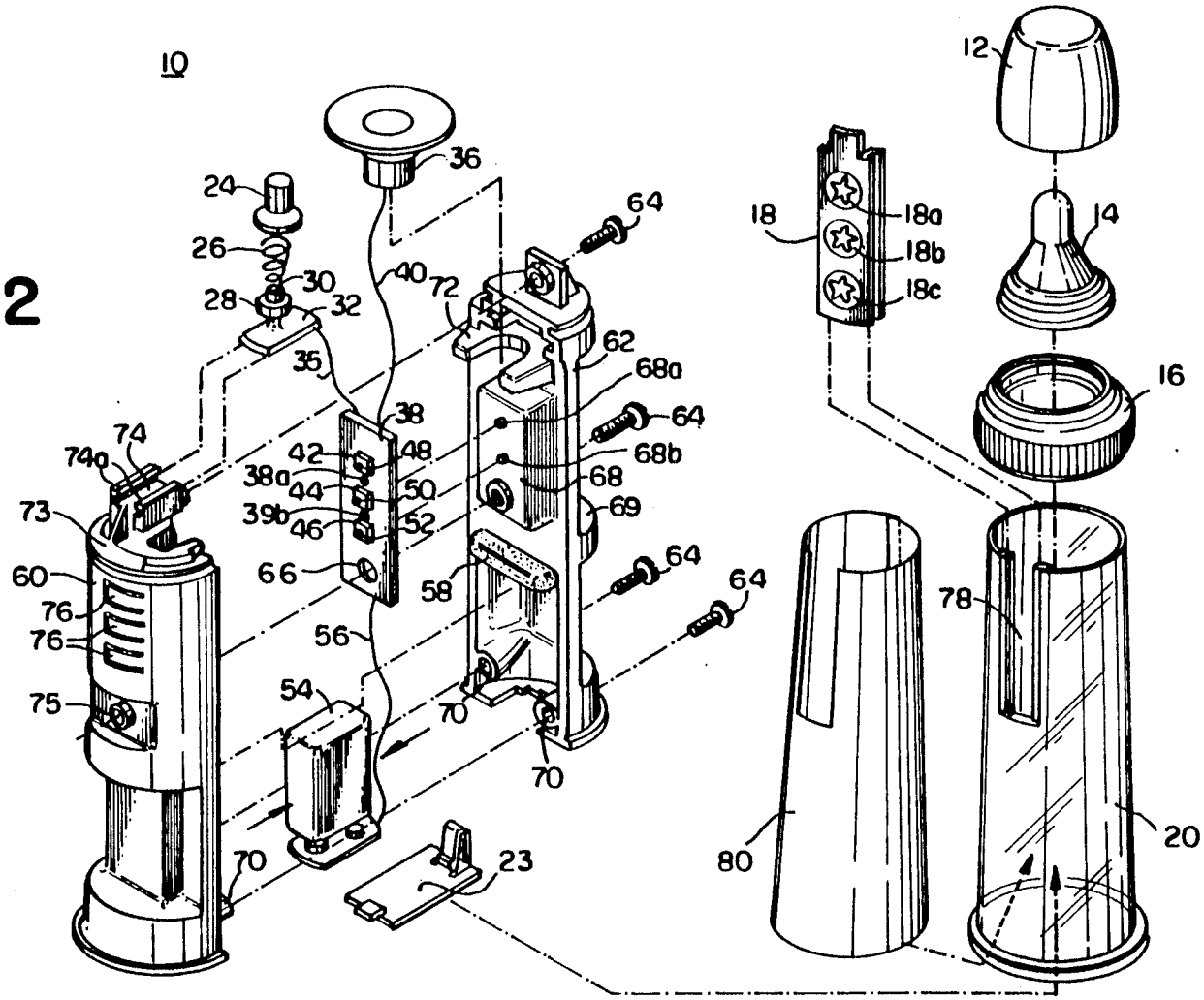
FIG. 2 is an exploded view of the toy baby bottle shown in FIG. 1.
Figure 5:
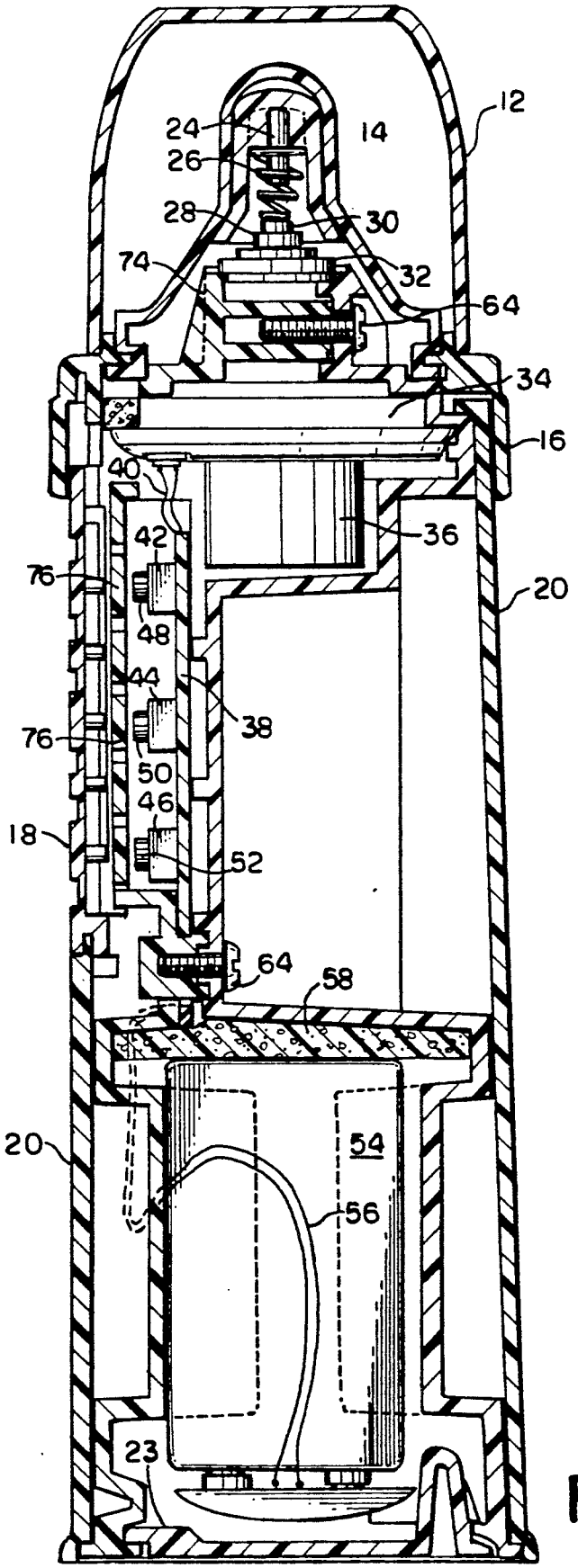
FIG. 5 is a cross-sectional view of the toy baby bottle shown in FIG. 1, taken along the lines 5—5.

FIG. 2 is an exploded view of the components comprising the bottle toy 10 of FIG. 1. The bottle toy 10, as previously indicated, contains a nipple-shaped member 14, a cap 16 and a cover 12. Contained within the nipple-shaped member 14 of the bottle toy 10 is an actuator means 24, a biasing means 26, a switch means 28, preferably a single-pole, single-throw microswitch including a button actuating means 30 and a printed circuit board (PCB) 32. The switch means 28, including the button actuating means 30, is mounted on the PCB 32. A sound transducer means 36, which is preferably a cone-type speaker bearing the same reference numeral in the figures, is located proximal the nipple-shaped member 14 within the cap 16 in the upper open end of the housing portion 20. The cone of speaker 36 is oriented toward that member 14 to generate sounds toward the member 14.

The switch means 28 is coupled by a wire connection 35 to a second PCB 38, which contains the circuit means 84 (shown in FIG. 6) for the bottle toy 10. Sound transducer means speaker 36 is connected to the second PCB 38, by means of a wire connection 40. Attached to the second PCB 38 are three switch means, preferably microswitches 42, 44 and 46 each including button actuating means 48, 50 and 52, respectively. Each one of the switch means 42, 44 and 46 closes upon depression of its associated button actuating means 48, 50 and 52. The button actuating means 48, 50 and 52 are covered by flexible member 18. The flexible member 18 preferably is a vinyl cover marked in such a way, for example, with embossed symbols 18*a*, 18*b* and 18*c*, so that the location of the underlying button actuating means 48, 50 and 52 are indicated. When pressure is applied to one of the symbols 18*a*, 18*b* or 18*c*, the pressure applied is transmitted to the button actuating means associated with the indicated symbol. Upon the transmittal of pressure to one of the button actuating means 48, 50 and 52, the particular switch means 42, 44 and 46 associated with the particular actuating means becomes operative.

The second PCB 38, which contains the circuit means 84, is powered by a battery means 54 connected to the PCB 38 preferably by means of wire connection 56. Preferably a cushion 58, is located between the battery means 54 and the PCB 38 to safely immobilize the battery means 54.

The internal components of the bottle toy 10 are held stable by a first or front chassis 60 and a second or rear chassis 62. Preferably, the first and second chassis 60 and 62 are generally hemispheric so as to reinforce the generally cylindrically-shaped housing portion 20 and to protect the circuit means 84 within the housing portion 20. A plurality of fastening members 64, preferably screws, serve to hold the first and second chassis 60 and 62 together.

The second PCB 38 is held in place by and between the first and second chassis 60 and 62. A fastening member 64 is connected from the second chassis to the first chassis through a hole 66 provided through the PCB 38. The second chassis 62 includes a rectangularly-shaped spacer or platform 68 to which the PCB 38 is mounted.

Pins 68*a*, 68*b* and boss 69 aligned with holes 38*a*, 38*b* and 66 respectively, are provided through the PCB 32 and assist in immobilizing the PCB 32. A fastening member 64 is passed through land 69 and PCB opening 66 to the front chassis 60 to draw the front chassis 60 against the second PCB board 38. Rectangularly-oriented lands (not shown) inside the front chassis 60 bear against edges of the second PCB board 38 to further immobilize the PCB 32 against the platform 68. The battery means 54 is also held stable by the first and second chassis 60 and 62. The cushion 58 is attached to the second chassis 62 and projects outward so when the battery means 54 is placed into the bottle toy 10, it is generally immobilized by the cushion 58 on one end and by a cover 23 on the base end 22. Preferably, the first and second chassis 60 and 62 are shaped to provide additional support for the battery means 54. Both chassis 60 and 62 include bosses 70 through which two of the fastening members 64 are inserted. The battery means 54 fits snugly between the bosses 70 located on the facing inner sides of the first and second chassis 60 and 62.

In the preferred embodiment of the invention, portions of the first and second chassis 60 and 62 are shaped to support the sound transducer means 36 and the components contained within the nipple-shaped member 14. The second chassis 62 includes a support member 72 forming a generally semicircular opening to receive the cone of the preferred transducer means 36. The first chassis 60 is provided with an adjoining, generally semicylindrical hollow chamber 73 having appropriate cutouts and lands to receive and immobilize the remainder of the transducer means 36 when the first and second chassis 60 and 62 are connected. Preferably, the first chassis 60 includes a raised member 74 located atop the chamber 73. The member 74 includes outer folded edges 74*a* which form a channel through which the first PCB 32 may be slidingly positioned.

The first chassis 60 preferably includes three resiliently flexible fingers 76 which cantilever from one side of the chassis 60 across openings provided in the chassis 60. When the first and second chassis 60 and 62 are together, the button actuating means 48, 50, and 52 on the PCB 38 lie under the openings and fingers 76. The chassis 60 and 62 upon insertion into the housing portion 20, preferably are aligned with the button actuating means 48, 50 and 52 and the fingers 76 on the first chassis 60 which are aligned with the opening 78 on the housing portion 20. The flexible member 18 is preferably positioned in and covers the opening 78 over the fingers 76 and the button actuating means 48, 50 and 52. Thus, as previously stated, when any symbol 18*a*, 18*b* and 18*c* is pressed, the pressure is transmitted through the flexible member 18 and the underlying fingers 76 to the underlying button actuating means 48, 50 and 52, respectively.

Preferably, the housing portion 20 is generally transparent and the label 80, preferably of printed paper, may be inserted into the housing portion 20 and suitably aligned with the opening 78 in order to surround the chassis 60 and 62 after insertion, to simulate the appearance of milk or other drinkable liquids. The label 80 can be printed with any other desired information as well.

Figure 4:
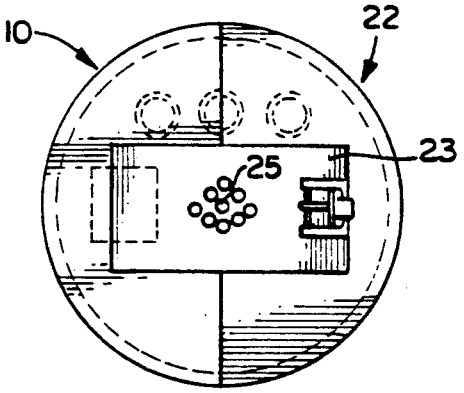
FIG. 4 is a bottom plan view of the toy baby bottle shown in FIG. 1.

FIG. 4 is a bottom plan view of the bottle toy 10 shown in FIG. 1. The base end 22 is partially formed by the exposed lower surfaces of the chassis 60 and 62. The remainder of the base 22 is formed by a removable panel 23 which allows the battery means 54 to be inserted and removed from the bottle toy 10. The base 22 may be provided with apertures 25 through the chassis 60 and 62 and/or the panel 23 through which the sounds generated by the sound transducer means 36 may be passed. The sound transducer means 36 is oriented in such a way that the sounds generated by it are directed primarily upward toward the nipple-shaped member 14.

Figure 6:
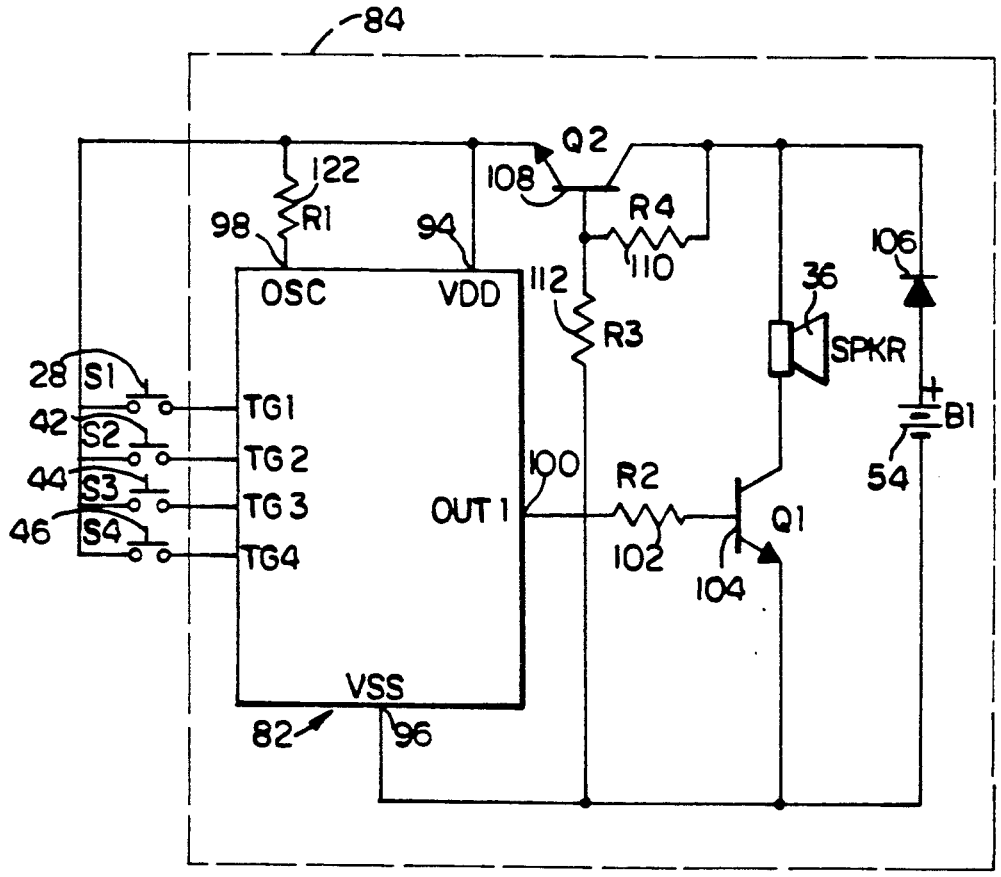
FIG. 6 is a schematic diagram showing the circuit means and transducer means of the toy baby bottle.

In the preferred embodiment of the invention, the bottle toy 10 selectively generates several different human-like sounds. The circuit means 84 for the bottle toy 10 is located primarily on the PCB 38. FIG. 6 is a schematic diagram showing the circuit means 84 preferred in the present embodiment of the invention. Preferably the circuit means 84 comprises a single-chip, synthesizing CMOS Very Large Scale Integrated Circuit (VLSI) 82, which is capable of synthesizing several different human voices. An example of such a single-chip synthesizer is the Mosel MSS0301, which is capable of synthesizing up to four different sounds, including human sounds, for a total of three seconds. The single-chip synthesizer CMOS VLSI 82 in the preferred embodiment of the invention is actuated by any one of four switches means 28, 42, 44, and 46 of the bottle toy 10. The switch means 28, 42, 44, and 46 are connected to trigger inputs 114, 116, 118, and 120, respectively, so when a switch triggers the associated trigger input, the synthesizer 82 generates and outputs the one transducer controlling signal which corresponds to the switch chosen. The circuit means 84 is powered by a power supply, which preferably comprises the battery means 54, which preferably is nine-volts. The positive end of the battery means 54 is connected to a voltage input 94 and to an RC oscillator input 98 on the synthesizer 82 through a transistor 108 to the base of transistor 108 through resistor 110 and to one side of the transducer means 36. A second transistor 104 couples the other side of the transducer means 36 to the negative end of the power supply. When the synthesizer 82 outputs a signal, it does so to a voltage output 100. The signal is transmitted through the resistor 102 to the base of transistor 104 which, when rendered conductive by the synthesizer signal, permits current to flow through the transducer means 36. In this way, the signal from the voltage output 100 of the synthesizer controls the transducer means 36 causing it to produce a generally human-like sound. A diode 106 on the positive supply side of the battery means 54 is provided to suppress the spike from the sound transducer means 36.

In the preferred embodiment of the invention, an ON/OFF switch is not required as the synthesizer 82 will emit signals only when one of the switch means 28, 42, 44 and 46 is actuated. A regulator subcircuit, which comprises transistor 108 and resistors 110 and 112 is included in the circuit means 84 in order to drop the power supplied to the synthesizer 82 from nine volts to five volts or less when the single-chip synthesizer 82 is idle. The regulator subcircuit thus increases the life of the battery means 54, as the circuit means 84 requires a lesser amount of power when the switch means 28, 42, 44 and 46 are not actuated.

The circuit means 84 is therefore capable of generating human-like sounds with transducer 36. The single-chip synthesizer 82 can be masked to encompass or store up to four different digitalized human-like sounds. Therefore, baby-like sounds such as drinking, laughing, crying, or burping can be generated and outputted by the circuit means 84 of the present invention.

In the preferred embodiment of the invention, the button actuating means 30 contained within the nipple-shaped member 14 will actuate its associated switch means 28 which will preferably cause the sound of a baby drinking from a bottle to be generated. Preferably, the button actuating means 30 can be actuated by pressing the nipple-shaped member 14 against the lips of a toy doll or other object. When pressure is applied to the actuator means 24, it compresses with the biasing means 26, causing pressure to be transmitted to the button actuating means 30 closing switch 28. Actuated in this manner, the baby bottle toy generates a drinking sound which gives the illusion that the toy doll is actually drinking.

While the drinking sound is generated by applying pressure to the nipple-shaped member 14, other sounds, preferably crying, laughing and burping are generated by depressing the button actuating means 48, 50 and 52, respectively, through flexible member 18. Flexible member 18 preferably is marked with symbols to identify where a child should apply pressure to the bottle toy in order to generate the human-like sounds. The symbols 18*a*, 18*b* and 18*c* on the vinyl cover preferably are ones that would appeal to a child, or are symbols which indicate the sound that will be generated when pressure is applied to one of the symbols. When a child applies pressure to any one of the symbols 18*a*, 18*b* or 18*c* on the flexible member 18, the pressure is transmitted through fingers 76 to one of the button actuating means 48, 50 and 52 and a sound will be generated by the circuit means 84.

Preferably, the bottle toy 10 is made out of durable materials, as it must withstand the rigors of a child's play. The housing portion 20 and the cover 12 which form the main exterior portion of the bottle toy 10 are preferably constructed out of a thermoplastic, such KRO3, while the nipple-shaped member 14 is preferably made out of a more flexible neoprene. Furthermore, the first and second chassis 60 and 62, which support the housing portion 20 and the components within it, are preferably constructed out of a high impact polystyrene.

The circuit means 84 is comprised of commercially-available components. As stated, the single-chip synthesizer 82 is preferably a Mosel MSS030, while the transistor 104 preferably is an 8050 driver NPN and transistor 108 is preferably a 9014 general purpose NPN. All of the resistors are one-quarter watt and five percent. Preferably, the value of the resistor 102 is 330, value of resistor 110 is 330 K, and the values of resistors 112 and 122 are 560 K and 1M2, respectively.

Thus, with the present invention, a child is able to use the bottle toy 10 to generate human-like sounds by either using the bottle toy 10 alone or in conjunction with another toy such as a doll by choosing the appropriate switch means. Since the bottle toy 10 is capable of generating a plurality of different human-like sounds, a child is able to choose a particular sound to be generated at a particular time. Since the sounds produced by the bottle toy 10 are electronically generated, it is possible that many different sounds could be generated by the bottle toy.

From the foregoing description, it can be seen that the present invention comprises an electronic sound-generating simulated baby bottle toy or drinking implement, such as a cup electronically generating human-like sounds. It will be appreciated by those skilled in the art that changes and modifications may be made from the above-described embodiment without departing from the inventor concept thereof. It is understood, therefore, that the present invention is not limited to the particular embodiment disclosed, but is intended to include all modifications and changes which are within the scope and spirit of the invention as defined by the appended claims.

We claim:

1. An electronic simulated baby bottle toy for electronically generating human-like sounds comprising:

a generally cylindrically-shaped hollow housing portion simulating a nurser bottle;

a generally nipple-shaped member mounted on one end of the housing portion;

sound transducer means covered by the housing portion and the nipple-shaped member and located proximal the nipple-shaped member for generating sounds proximal the nipple-shaped member, said sounds appearing to come from an object when the bottle toy is used to simulate feeding of the object;

circuit means within the housing portion coupled with the sound transducer means for generating a signal controlling the sound transducer means to produce a human-like sound, and a plurality of switch means actable from outside the toy for selectively activating the circuit means to control the sound transducer means.

2. The simulated baby bottle toy as recited in claim 1, further comprising battery means located within the cylindrically-shaped housing portion for powering the circuit means.

3. The simulated baby bottle toy as recited in claim 1, wherein said simulated sound transducer is oriented to generate sounds towards the nipple-shaped member.

4. The simulated baby bottle toy as recited in claim 1, wherein the circuit means is adapted to generate a plurality of different signals controlling the sound transducer means to produce different human-like sounds and each switch means includes push-button actuating means for operating the switch means to selectively generate the different signals.

5. The simulated baby bottle toy as recited in claim 4, further comprising first and second generally hemispheric chassis within the cylindrically-shaped hollow housing portion, the first and second chassis supporting each of the switch means and the circuit means.

6. The simulated baby bottle toy as recited in claim 5, wherein the first chassis includes at least one opening in which at least one of said button actuating means is located, the chassis opening being aligned with an opening on the cylindrically-shaped hollow housing portion.

7. The simulated baby bottle toy as recited in claim 6, further comprising a flexible member covering the opening in the cylindricallyshaped hollow housing portion whereby pressure may be applied from outside the housing portion through the flexible member to at least one button actuating means in the chassis opening.

8. The simulated baby bottle toy as recited in claim 4, wherein one of the switch means is located on a separate member spanning the sound transducer means.

9. The simulated baby bottle toy as recited in claim 8, further comprising biasing means within the generally nipple-shaped member positioned for actuating the button actuating means of one switch means.

10. The simulated baby bottle toy as recited in claim 9, further comprising an actuator member within an upper portion of the generally nipple-shaped member and spaced apart from the button actuating means by the biasing means.

11. The simulated baby bottle toy as recited in claim 10, wherein upon the application of pressure to the actuator member, the biasing means depresses the one button actuating means to operate the one switch means.

12. The simulated baby bottle toy as recited in claim 1, further comprises a base end on a side of the hollow housing portion opposite the nipple-shaped member, the base end including multiple apertures through which the sounds generated by the sound transducer means are partially passed.

13. The simulated baby bottle toy as recited in claim 1, wherein the said cylindrically-shaped hollow housing portion is generally transparent, and further comprises a label located within the generally transparent cylindrically-shaped housing portion colored to simulate milk.

14. An electronic simulated baby bottle toy for electronically generating a plurality of human-like sounds comprising:

a generally cylindrically-shaped hollow housing portion simulating a nurser bottle;

a generally nipple-shaped member mounted on one end of the housing portion;

sound transducer means within the housing portion and nipple-shaped member for generating sounds within the toy;

circuit means within the housing portion and coupled with the sound transducer means, the circuit means being configured for generating a plurality of signals controlling the sound transducer means to produce a plurality of different human-like sounds; and a plurality of switch means selectively controllable from outside the housing portion and nipple-shaped member for selectively activating the circuit means to selectively produce any of the plurality of different human-like sounds, at least one of the switch means being located within the nipple-switch member for activation by contacting the nipple-shaped member.

15. The toy as recited in claim 14 wherein at least one of the switch means is located with respect to the hollow housing portion to be activated by contacting an exterior part of the toy other than the nipple-shaped member.

16. The toy as recited in claim 14 wherein the circuit means in configured to produce at least one child vocal sound selected from the group consisting essentially of crying, laughing and burping.

* * * * *